US005085551A

United States Patent [19]

Erdbories et al.

[11] Patent Number: 5,085,551

[45] Date of Patent: Feb. 4, 1992

[54] BOOK BLOCK SEWING METHOD AND APPARATUS

[75] Inventors: Ulrich Erdbories, Rahden, Fed. Rep. of Germany; Robert C. Schuler, Woodcliff Lake, N.J.

[73] Assignee: Kolbus GmbH & Co. KG, Rahden, Fed. Rep. of Germany

[21] Appl. No.: 685,523

[22] Filed: Apr. 15, 1991

[30] Foreign Application Priority Data

Apr. 14, 1990 [DE] Fed. Rep. of Germany ..... 4012082

[51] Int. Cl.[5] ..... B42B 2/00

[52] U.S. Cl. ..... 412/6; 412/35

[58] Field of Search ..... 227/67; 412/6, 35

[56] References Cited

U.S. PATENT DOCUMENTS 4,704,973 11/1987 Horst ..... 412/35

FOREIGN PATENT DOCUMENTS 642999 3/1937 Fed. Rep. of Germany .

1263686 3/1968 Fed. Rep. of Germany .

*Primary Examiner*—Paul A. Bell

*Attorney, Agent, or Firm*—Chilton, Alix & Van Kirk

[57] ABSTRACT

In the sewing of individual book block sections to define a thread-sewn book block, needles which pre-pierce the book block section to facilitate sewing are caused to remain in engagement with the block section during its transfer from a feed position to the sewing position. During the pre-piercing operation, the book block section is held against a sewing saddle by means of an apertured hold-down element, the tips of the pre-piercing needles being received in the hold-down element.

8 Claims, 1 Drawing Sheet

BOOK BLOCK SEWING METHOD AND APPARATUS

BACKGROUND OF THE INVENTION

1. Field of the Invention

The present invention relates to the manufacture of books and particularly to the assembly of book blocks by sewing individual block sections together. More specifically, this invention is directed to apparatus for sewing together book block sections and especially to sewing apparatus which sequentially performs pre-piercing and sewing operations while preventing undesired relative movement between the block section and a sewing saddle on which it is supported. Accordingly, the general objects of the present invention are to provide novel and improved methods and apparatus of such character.

2. Description of the Prior Art

In a known method for thread-sewing book block sections together to define a book block, a sewing needle punches a thread through the fold of each individual block section, and this thread is transferred to a hook needle which is then thrust through the fold at a distance from the sewing needle. The hook needle carries the thread, in the form of a loop, out of the block section and causes it to be linked with a previously formed loop associated with the preceding block section. The apparatus for performing the above-briefly described sewing technique is known in the art as a "sewing-press". A conventional sewing press consists of a sewing head, an oscillating sewing saddle and a delivery table for discharging the sewn book blocks. The sewing saddle feeds the individual book blocks sections to the sewing head where the above-described sewing method is performed. A sewing saddle customarily includes a pre-piercing mechanism. The pre-piercing mechanism is equipped with a linear array of needles which perforate the book block section, typically from the inside to the outside, at predetermined locations along the fold "gutter". The object of the pre-piercing is to minimize the resistance which will be encountered by the sewing and hook needles, which are subsequently punched through the fold gutter, thereby minimizing needle misalignment and breakage.

The initiation of operation of the pre-piercing mechanisms of prior art book block sewing apparatus occurs prior to the sewing saddle stopping in the sewing position. The pre-piercing needles, after punching through the block section fold gutter, are caused to return downwardly to their initial position and the block section is then moved into the position where the sewing needles and hook needles are forced through the holes which have been pre-pierced. Before entering the sewing position, the book block section will be engaged by a hold-down element, typically in the form of a leaf spring, which presses the block section against the sewing saddle during the pre-piercing operation.

The problem of possible book block section misalignment is of long standing in the art. Misalignment can occur as a result of the frictional forces between the book block spine and the hold-down element during the movement of the block section from the point at which the pre-piercing occurs to the sewing position. This misalignment is known in the art as "block section rolling" and results in the sewing needles missing the middle of the block section gutter which can cause the needles to break and the threads to snap. Furthermore, even if needle or thread breakage does not occur, a book block section containing block sections which have been sewn at locations offset from the fold is invariably of inferior quality and may result in breakdowns or production disruptions in the course of subsequent processing operations.

SUMMARY OF THE INVENTION

The present invention overcomes the above briefly discussed and other deficiencies and disadvantages of the prior art and, in so doing, provides a novel and improved method of sewing individual book block sections together to define a book block. The present invention also encompasses apparatus for use in the implementation of the aforesaid method, this apparatus enabling a substantial increase in functional reliability and sewing quality to be realized without a substantial increase in equipment complexity or cost.

In the practice of the present invention, book block sections are pre-pierced, while supported on a sewing saddle at a feed position, and the pre-piercing needles are caused to remain in engagement with the block section during its transfer to the sewing position. The book block section will, during the pre-piercing operation, be pressed against the sewing saddle.

Apparatus in accordance with the invention comprises a sewing saddle which is movable between a feed position and a sewing position. The apparatus further comprises a sewing head, pre-piercing needles which are associated with the sewing saddle and a hold-down element. The hold-down element, which in the preferred embodiment has a shape which is partly complementary to the shape of the sewing saddle, can be brought into a functional relationship with the sewing saddle to press the book block section against the saddle prior to activation of the pre-piercing needles. The hold-down element is provided with a cut-out or cut-outs for receiving the leading ends of the pre-piercing needles. The pre-piercing needles are activated subsequent to the positioning of the hold-down element to immobilize the book block section on the saddle and when the sewing saddle is in the feed position.

BRIEF DESCRIPTION OF THE DRAWING

The present invention may be better understood, and its numerous objects and advantages will become apparent to those skilled in the art, by reference to the accompanying drawing wherein like reference numerals refer to like elements in the two figures and in which.

DESCRIPTION OF THE DISCLOSED EMBODIMENT

Figure 1:
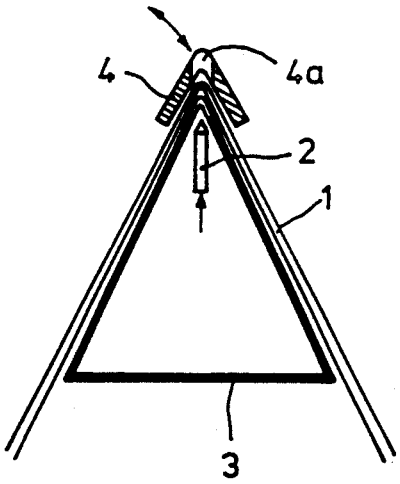
FIG. 1 is a schematic showing of an initial step in the practice of the present invention, FIG. 1 depicting the sewing saddle in the feed position.

With reference now to the drawing, at the feed position represented in FIG. 1, a book block section 1 has been properly positioned on a sewing saddle 3. In the position shown, the block section is ready for the pre-piercing operation which is performed by causing pre-piercing needles 2 to penetrate the book block section 1 from the inside to the outside at predetermined locations in its "fold gutter".

In order to enable the pre-piercing operation to be performed, the book block section 1 must be immobilized so that the block section neither moves upwardly nor rolls as a result of the forces applied thereto by the array of pre-piercing needles. To this end, a hold-down element 4 will, as indicated by the double-ended arrow, be swung into position. The hold-down element 4 is provided with a cut-out or cut-outs 4*a* which receive the ends of the pre-piercing needles 2. The hold-down element 4 is shaped to engage the sewing saddle 3, i.e., the hold-down element 4 is contoured to be generally complementary in shape to the upper end of the sewing saddle and a book block section supported thereon. The means for imparting movement to the sewing saddle 3, the pre-piercing needles 2 and the hold-down element 4 have not been shown in the interest of facilitating understanding of the invention. These movements, however, are produced by actuating means which are known per se.

Figure 2:
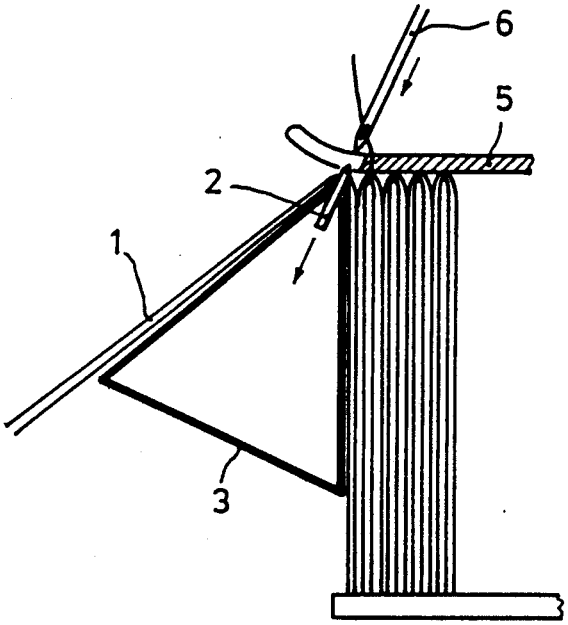
FIG. 2 shows the sewing saddle translated into the sewing position.

Once the book block section 1 has been pre-pierced, the hold-down element 4 will be retracted but the pre-piercing needles 2 will remain in engagement with the block section 1. Thus, as the sewing saddle 3 moves, with the book block section 1, from the feed position of FIG. 1 to the sewing position of FIG. 2, relative movement between the book block section and the sewing saddle is prevented by the engagement of the pre-piercing needles with the block section. The spine of the book block section 1, accordingly, cannot slip on the sewing saddle 3 when the block section, guided by a downwardly-acting guide plate 5, enters the sewing station. When the sewing saddle reaches the sewing position, the pre-piercing needles 2 are withdrawn so as to allow the sewing needles 6 to pass through the holes which have been pre-pierced so that the sewing operation can be performed in the customary manner.

The present invention eliminates the problem of "block section rolling" since the book block section 1 remains on the sewing saddle 3, positively restrained from movement relative to the sewing saddle by the pre-piercing needles, during transport from the feed position to the sewing position. Accordingly, the present invention precipitates a substantial increase in functional reliability and an improvement in sewing quality. Also, when the present invention is practiced, needle and thread breakage does not occur.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a method for sewing together individual book block sections to define a book block, the sewing being accomplished with the aid of a sewing saddle which transfers the book block section from a feed position to a sewing position, the book block section being pre-pierced at plural predetermined locations by an array of piercing needles prior to sewing and while supported on the sewing saddle, the improvement comprising:

activating the pre-piercing needles when the sewing saddle is in the feed position with a book block section supported thereon to thereby pre-pierce the block section;

maintaining the pre-piercing needles in engagement with the book block section during the transfer thereof from the feed position to the sewing position; and retracting the pre-piercing needles prior to initiation of the sewing operation.

2. The method of claim 1 further comprising the step of:

capturing the book block section between the sewing saddle and an apertured hold-down element prior to activating the pre-piercing needles.

3. The method of claim 2 wherein the hold-down element is moved away from the sewing saddle subsequent to the pre-piercing and prior to the transfer.

4. The method of claim 3 wherein the book block section is engaged by a hold-down element at the sewing position before withdrawal of the pre-piercing needles therefrom.

5. The method of claim 1 wherein the book block section is engaged by a hold-down element at the sewing position before withdrawal of the pre-piercing needles therefrom.

6. In apparatus for the sewing together of individual book block sections to define a thread-sewn book block, the apparatus including a sewing saddle which is movable from a feed position to a sewing position, an array of pre-piercing needles being associated with the sewing saddle, the apparatus further including a sewing head having sewing needles located at the sewing position, the improvement comprising:

apertured hold-down means, said hold-down means being movable relative to the sewing saddle whereby the hold-down element may be caused to immobilize a book block section on the sewing saddle at the feed position, pre-piercing needles passing through the fold of the book block section and into an aperture in the hold-down element when activated, the hold-down element subsequently being moved away from the sewing saddle whereby the sewing saddle with the book block section supported thereon and engaged by the pre-piercing needles may be moved into registration with the sewing head.

7. The apparatus of claim 6 wherein said hold-down means comprises a hold-down element which is generally complementary in shape to the portion of the sewing saddle which engages and supports the fold gutter of the book block section.

8. The apparatus of claim 7 wherein said hold-down element is generally V-shaped and each aperture for receiving a piercing needle is formed in the base of the V.

* * * * *